US007846309B2

(12) United States Patent
Nguyen et al.

(10) Patent No.: US 7,846,309 B2
(45) Date of Patent: Dec. 7, 2010

(54) METAL ELECTROWINNING CELL WITH ELECTROLYTE PURIFIER

(75) Inventors: Thinh T. Nguyen, Onex (CH); Frank Schnyder, Chardonne (CH); Vittorio De Nora, Nassau (BS)

(73) Assignee: Rio Tinto Alcan International Limited, Montreal (CA)

( * ) Notice: Subject to any disclaimer, the term of this patent is extended or adjusted under 35 U.S.C. 154(b) by 747 days.

(21) Appl. No.: 10/565,524

(22) PCT Filed: Aug. 10, 2004

(86) PCT No.: PCT/IB2004/051437

§ 371 (c)(1),
(2), (4) Date: Jan. 23, 2006

(87) PCT Pub. No.: WO2005/017234

PCT Pub. Date: Feb. 24, 2005

(65) Prior Publication Data

US 2006/0185984 A1 Aug. 24, 2006

(30) Foreign Application Priority Data

Aug. 14, 2003 (WO) ..... PCT/IB03/03651

(51) Int. Cl.
*C25C 3/08* (2006.01)
*C25C 3/06* (2006.01)

(52) U.S. Cl. ..... 204/245; 204/243.1; 205/372; 205/385; 205/386; 205/387

(58) Field of Classification Search ..... 204/243.1, 204/245; 205/372, 385, 386, 387
See application file for complete search history.

(56) References Cited

U.S. PATENT DOCUMENTS

| | | | | |
|---|---|---|---|---|
| 4,115,215 | A * | 9/1978 | Das et al. | 205/377 |
| 4,214,956 | A * | 7/1980 | Bowman | 205/377 |
| 4,670,110 | A * | 6/1987 | Withers et al. | 205/362 |
| 6,245,201 | B1 * | 6/2001 | Rendall | 204/247 |
| 2004/0216997 | A1 * | 11/2004 | De Nora | 204/297.01 |
| 2005/0269202 | A1 * | 12/2005 | De Nora et al. | 204/243.1 |

* cited by examiner

*Primary Examiner*—Bruce F Bell

(57) ABSTRACT

A cell for electrowinning a metal, in particular aluminium, from a compound thereof dissolved in an electrolyte (30) comprises an anode (40) and a cathode (10,11) that contact the electrolyte (30), the cathode (10,11) being during use at a cathodic potential for reducing thereon species of the metal to be produced from the dissolved compound. The electrolyte (30) further contains species of at least one element that is liable to contaminate the product metal (20) and that has a cathodic reduction potential which is less negative than the cathodic potential of the metal to be produced. The cell further comprises a collector (50) for removing species of such element (s) from the electrolyte (30). During use the collector (50) is at a potential that is: less negative than the cathodic potential of the produced metal (20) to inhibit reduction thereon of species of the metal to be produced; and at or more negative than the reduction potential of the species of said element(s) to allow reduction thereof on the collector (50). The cell is so arranged that species of said element(s) are reduced on the collector (50) rather than on the cathode (10, 11) so as to inhibit contamination of the product metal (20) by said element(s).

23 Claims, 5 Drawing Sheets

METAL ELECTROWINNING CELL WITH ELECTROLYTE PURIFIER

FIELD OF THE INVENTION

The invention relates a cell for the electrowinning of a metal, in particular aluminium from alumina dissolved in a molten electrolyte. The invention is in particular concerned with the production by electrolysis of aluminium having a high level of purity.

BACKGROUND OF THE INVENTION

The electrowinning of a metal from a compound thereof dissolved in an electrolyte is usually followed by a purification process of the product metal. In order to minimise the subsequent purification process, the metal is advantageously electrowon in an environment which contains no or little elements (or species thereof) that are liable to contaminate the produced metal. In commercial metal electrowinning, contamination of the product metal is minimised by avoiding the introduction of contaminating elements into the electrolyte, in particular by controlling the purity of the raw material that is used.

In the field of aluminium electrowinning the contamination of the product aluminium is due to the impurities present in the raw material, usually alumina containing a small amount of iron oxide, and to elements found in the structure of the aluminium electrowinning cell that dissolve during operation in the electrolyte, for example sulphur or nickel found in carbon anodes.

With the development of non-carbon aluminium electrowinning anodes and the operation of cells without crust and ledge, the likelihood of contaminating the product aluminium by elements from the cell structure has significantly increased.

It is known to produce aluminium with a low contamination level by purifying the product aluminium after electrowinning, for example by degassing the molten aluminium outside the aluminium electrowinning cell as disclosed in U.S. Pat. No. 4,668,351 (Dewing/Reesor), as well as in WO00/63630 (Holz/Duruz), WO01/42168 (de Nora/Duruz), WO01/42531 (Nguyen/Duruz/de Nora), WO02/096830 (Duruz/Nguyen/de Nora) and WO02/096831 (Nguyen/de Nora).

There is a great incentive to use non-carbon anodes to improve the aluminium production process by reducing pollution and the cost of aluminium production. Many proposals have been made to replace carbon anodes which are still commonly used in industry by non-carbon anodes.

The materials having the greatest resistance to oxidation are metal oxides which are all to some extent soluble in cryolite. Oxides are also poorly electrically conductive, therefore, to avoid substantial ohmic losses and high cell voltages, the use of oxides should be minimal in the manufacture of anodes. Whenever possible, a good conductive material should be utilised for the anode core, whereas the surface of the anode is preferably made of an oxide having a high electrocatalytic activity.

Only recently has it become possible to produce metal-based anodes that can resist the cell's environment for several hundred hours and even longer and that are sufficiently electrically conductive so as to permit commercial use. These recent developments, in particular anodes made of an electrically conductive metal anode core with an oxide-based active outer part, have been disclosed in several patents, such as, U.S. Pat. No. 6,077,415 (Duruz/de Nora), U.S. Pat. No. 6,103,090 (de Nora), U.S. Pat. Nos. 6,113,758, 6,248,227, 6,361,681 (all de Nora/Duruz), U.S. Pat. No. 6,365,018 (de Nora), U.S. Pat. No. 6,379,526 (de Nora/Duruz), U.S. Pat. No. 6,521,115 (Duruz/de Nora/Crottaz), U.S. Pat. No. 6,562,224 (Crottaz/Duruz) and PCT applications, WO00/40783, WO01/42534 (both de Nora/Duruz), WO01/42536 (Duruz/Nguyen/de Nora), WO02/070786 (Nguyen/de Nora) and WO02/083990 (de Nora/Nguyen), WO02/083991 (Nguyen/de Nora), WO03/014420 (Nguyen/Duruz/de Nora), WO03/078695 (Nguyen/de Nora), WO03/087435 (Nguyen/de Nora), WO2004/018731 (Nguyen/de Nora), WO2004/024994 (Nguyen/de Nora), WO2004/044268 (Appourchaux/Nguyen/de Nora).

The replacement of carbon anodes by metal-based anodes leads to the presence of anode metal species dissolved in the electrolyte and reduced in the cathodic product aluminium. It has been proposed to prevent contamination of the product aluminium with an unacceptable amount of such metal species by operating the cell under strictly controlled conditions, as described in some of the above references, as well as in U.S. Pat. No. 6,540,887 (de Nora), U.S. Pat. No. 6,521,116 (Duruz/de Nora/Crottaz), U.S. Pat. No. 6,572,757 (de Nora/Berclaz), and PCT applications WO00/40781 (de Nora), WO01/31086 (de Nora/Duruz), WO01/42535 (Duruz/de Nora), WO02/097167 (Nguyen/de Nora), WO03/006716 (de Nora), WO03/006717 (Berclaz/Duruz), WO03/023092 (de Nora), and US publication 2003/0075454 (de Nora/Duruz).

US2004/0020786 (LaCamera et al.) published Feb. 5, 2004 discloses removal of sulphur from the electrolyte of an aluminium production cell in order to increase the cell's current efficiency. In several embodiments a purifying electrode is used in the electrolyte to remove the sulphur. Such an electrode is hidden behind a wall in an oxygen-free zone outside the main electrolyte stream to avoid exposure to anodically evolved oxygen. This publication recognises that iron impurities are disadvantageous for the current efficiency, particularly in combination with sulphur, but discloses only a method to remove sulphur and not iron.

As mentioned above, alumina that is used as the raw material for the commercial electrowinning of aluminium usually contains about 500-1000 ppm iron species which during electrowinning are reduced at the cathode and contaminate the product aluminium. It is not possible to limit iron contamination originating from the alumina feed by the methods described in the above mentioned references. The electrolyte of an aluminium electrowinning cell usually contains small quantities of contaminating impurities, typically up to 500 ppm iron and below 200 ppm nickel and possibly other elements, which should not be collected in the electrowon aluminium. There remains a need for reducing the contamination of aluminium during electrowinning.

SUMMARY OF THE INVENTION

A major object of the invention is to increase the purity of metal produced by the electrolysis of an electrolyte containing a dissolved compound of the metal, in particular the electrowinning of aluminium from alumina, by inhibiting reduction in the electrowon metal of species of elements other than the metal to be produced which species are present in the electrolyte.

The invention relates to a cell for electrowinning a metal from a compound thereof dissolved in a molten salt electrolyte, in particular aluminium from dissolved alumina. This cell comprises an anode and a cathode that contact the molten electrolyte, the cathode being during use at a cathodic potential for reducing thereon species of the metal to be produced from the dissolved compound. The electrolyte further contains species of at least one element that is liable to contaminate the product metal and that has a cathodic reduction potential which is less negative than the cathodic potential of the metal to be produced.

According to invention, the cell further comprises a collector for removing species of said element(s) from the electrolyte, the collector having an electrically conductive surface in contact with the molten electrolyte. During use the conductive collector surface is at a potential that is less negative than the cathodic potential of the produced metal to inhibit reduction thereon of species of the metal to be produced, and at or more negative than the reduction potential of the species of said element(s) to allow reduction thereof on the conductive collector surface. The cell is so arranged that species of said element(s) are reduced on the conductive collector surface rather than on the cathode so as to inhibit contamination of the product metal by said element(s).

The present invention is concerned with the removal of elements that are liable to contaminate unacceptably the produced metal. Therefore the collector of the present invention should be placed at a location at which a substantial part of these elements can be intercepted before reaching the produced metal. Conversely, the abovementioned US2004/0020786 is concerned with the removal of sulphur which is not liable to contaminate unacceptably the product aluminium in conventional carbon anode cells or non-carbon anode cells. As disclosed in this publication, a purification electrode used to remove sulphur is hidden in an oxygen-free area outside the main electrolyte stream and shielded therefrom, i.e. this electrode is not at a location at which a substantial part of contaminating elements are intercepted and reduced on the purification electrode before reaching the produced metal.

The metal which is electrowon in such a cell is for example aluminium, magnesium, titanium, manganese, sodium, potassium, lithium, zirconium, tantalum or niobium. Aluminium can be produced from alumina dissolved in a fluoride (or possibly chloride) based molten electrolyte.

The elements that are liable to contaminate the product metal depend on the type of metal electrowinning and cell operating conditions. Such elements can be metals, metalloids and non-metals. Examples of contaminating elements are given below.

It is understood that the fact that the collector potential has to be "less negative" than the cathodic potential does not necessarily imply that both the collector potential and the cathodic potential are negative. Depending on the potential referential that is used, it can also mean that: the cathodic potential is negative whereas the collector potential is non-negative (for example an anodic potential at 3 V, a cathodic potential at −0.5 V and a collector potential at +0.5 V); or both potentials are non-negative, the collector potential being higher than the cathodic potential (for example an anodic potential at 3.5 V, a cathodic potential at 0 V and a collector potential at +1 V).

By using such a collector, species of elements that have a reduction potential that is less negative than species of the metal to be produced, can be selectively removed from the electrolyte by exposure to the collector and do not reach the cell's cathode. Consequently, the metal product does not get contaminated by these elements that are plated from the molten electrolyte onto the collector of the invention before reaching the cathode.

Advantageously, the cell is arranged to promote during use an electrolyte circulation from and towards the cathode, the conductive collector surface being exposed to molten electrolyte that circulates towards the cathode and that contains the species of said element(s). By canalising the circulating electrolyte to the collector surface before it reaches the cathode, deposition of these species in the cathodically produced metal can be minimised or even nearly eliminated.

For instance, when the electrolyte escapes the anode-cathode gap after exposure to the anode before being circulated towards the cathode, for example as shown in WO00/40781, WO00/40782, WO03/006716, WO03/023091 and WO03/023091 (all de Nora) in the case of aluminium electrowinning, the conductive collector surface can be positioned outside the anode-cathode gap on the electrolyte path. In such a case, the conductive surface should be electrically connected to a means for applying a potential.

Alternatively, the conductive collector surface is positioned between the anode and the cathode. In this configuration, the conductive collector surface can be electrically connected to a voltage source, or the potential can be set by its position relative to the anode and cathode.

The cell may comprise a means for supplying to the conductive collector surface a current for reducing species of the contaminating element(s) on the conductive collector surface during use. The means for supplying current can include a resistor between the cathode and the collector or a separate external current source. The current supplied to the collector surface can also be used to obtain the desired potential of the collector surface.

To reduce species of the contaminating element(s) on the conductive surface, an electric charge may be supplied to this surface by oxidation on this surface of product metal and/or another metal that is/are dissolved in the electrolyte. In the case of aluminium electrowinning, dissolved aluminium and/or dissolved sodium metal (e.g. produced by reduction of sodium ions from a sodium fluoride-containing electrolyte) can supply to the collector surface an electric charge by oxidation on this surface.

At the usual contamination level of the electrolyte, e.g. in the case of an aluminium electrowinning cell operating with metal-based anodes, the collector current is typically maintained below 1% of the anode current, in particular below 0.5%, often below 0.30%. This is sufficient to remove significantly the contaminating elements from the electrolyte and inhibit and produce a high purity aluminium.

The conductive surface of the collector can be made of carbon. Alternatively, the conductive surface may be metal-based, in which case the conductive surface is at a potential below the potential of electrochemical dissolution of the metal-based surface. Suitable metal-based surfaces include surfaces that comprise at least one metal selected from titanium, vanadium, chromium, manganese, iron, cobalt, nickel, copper, yttrium, zirconium, niobium, molybdenum, ruthenium, rhodium, palladium, hafnium, tungsten, rhenium, iridium, platinum, gold, or a compound thereof, in particular an oxide or a boride.

The species of contaminating elements that can be collected on the collector of the invention usually comprise species of at least one metal selected from nickel, iron, copper, cobalt, titanium, chromium, manganese, yttrium, cadmium, tin, antimony, gold, platinum, silver, cerium, palladium, ruthenium, tungsten, bismuth and lead. When the cell has a metal-based anode, the anode has a surface that usually includes at least one of this list of metals or a compound thereof, such as an oxide. Suitable metal-based anode compositions for aluminium electrowinning are given in the references discussed in the background of the invention.

Other species of element(s) that are liable to contaminate the product metal and that can be removed from the electrolyte by using the above collector include species of metalloids, such as silicon or boron, and/or non-metals, such as sulphur.

The invention also applies to cells that operate with carbon anodes. In particular, the collector can be used with any known carbon anode cell for the electrowinning of aluminium, such as Hall-Héroult cells or Søderberg cells. In such a case, the collector is advantageously used to remove from the electrolyte species of iron that comes as an impurity of the fed alumina, as mentioned above, as well as anode constituents and/or impurities that dissolve into the electrolyte.

The conductive collector surface can be formed by one or more elongated members. For example, the conductive collector surface is formed by a wire, in particular a spiral. Alternatively, the conductive collector surface may be formed by on or more bars, in particular an assembled or cast grid, or any other foraminate structure through which the electrolyte can circulate, in particular a structure in the form of a perforated plate, a honeycomb structure or a foam.

Another aspect of the invention relates to a method of electrowinning a metal, in particular aluminium, in a cell as described above. This method comprises:

a) setting the cathode at a cathodic potential for reducing thereon species of the metal to be produced;
b) setting the conductive surface of the collector at a cathodic potential that is:
   less negative than the cathodic potential of the metal to be produced to inhibit reduction thereon of species of the metal to be produced; and
   at or more negative than the reduction potential of the species of the contaminating element(s);
c) producing the metal on the cathode from the dissolved compound of the metal to be produced; and
d) reducing species of the contaminating element(s) on the conductive collector surface rather than on the cathode so as to inhibit contamination of the product metal by said element(s).

Usually, the conductive collector surface is at a potential in the range from 0.5 to 1.5 V above the cathodic potential of the metal to be produced, in particular from 0.7 to 1.2 V thereabove, so as to inhibit reduction of species of the metal to be produced on the collector. Such a potential is also sufficiently low to prevent dissolution of the collector surface when it is metal-based.

A further aspect of the invention relates to a cell for electrowinning aluminium from alumina dissolved in a molten electrolyte that contains species of at least one element which is liable to contaminate the product aluminium. The cell comprises an anode and a cathode that contact the molten electrolyte. During use, the cathode is at a cathodic potential for reducing thereon aluminium species from the dissolved alumina.

According to the invention, the cell further comprises a collector for removing species of said element(s) from the electrolyte. The collector has a surface in contact with the molten electrolyte. The cell is so arranged that species of said element(s) dissolved in the molten electrolyte are collected on the collector surface rather than on the cathode so as to inhibit contamination of the product aluminium by said element(s).

Yet another aspect of the invention relates to method of electrowinning aluminium in such a cell. The method comprises producing aluminium on the cathode from the dissolved alumina, and collecting species of said element(s) on the collector surface rather than on the cathode so as to inhibit contamination of the product aluminium by said element(s).

These aluminium electrowinning cell and process can incorporate any of the above described cell or method features.

Yet a further aspect of the invention relates to a cell for electrowinning a metal from a compound thereof that is dissolved in an electrolyte. The cell comprises an anode and a cathode that contact the electrolyte, the cathode being during use at a cathodic potential for reducing thereon species of the metal to be produced from the dissolved compound. The electrolyte further contains species of at least one element that is liable to contaminate the metal product and that has a cathodic reduction potential that is less negative than the cathodic potential of the metal product.

According to the invention, the cell further comprises a collector for collecting species of said element(s), the collector having an electrically conductive surface in contact with the electrolyte. During use, the conductive collector surface is at a potential that is less negative than the cathodic potential of the produced metal to inhibit reduction of species of the metal to be produced on the conductive collector surface, and at or more negative than the reduction potential of species of said elements to allow reduction thereof on the conductive collector surface. The cell is so arranged that species of said element(s) are reduced on the conductive collector surface rather than on the cathode so as to inhibit contamination of the product metal by said element(s).

The metal to be produced may be any of the above listed metals, such as aluminium, magnesium and titanium, as well as metals produced by electrolysing aqueous electrolytes, such as zinc which can be protected from cadmium contamination by using the collector.

Moreover, the invention also relates to a method of electrowinning a metal in such a cell. The method comprises producing the metal on the cathode from said dissolved compound, and collecting species of said element(s) on the collector surface rather than on the cathode so as to inhibit contamination of the product metal by said element(s).

This cell and process can incorporate any suitable features that have been described above in relation with the cells and electrowinning processes, respectively.

BRIEF DESCRIPTION OF DRAWINGS

The invention will be further described with reference to the accompanying schematic drawings, in which.

DETAILED DESCRIPTION

Figure 1:
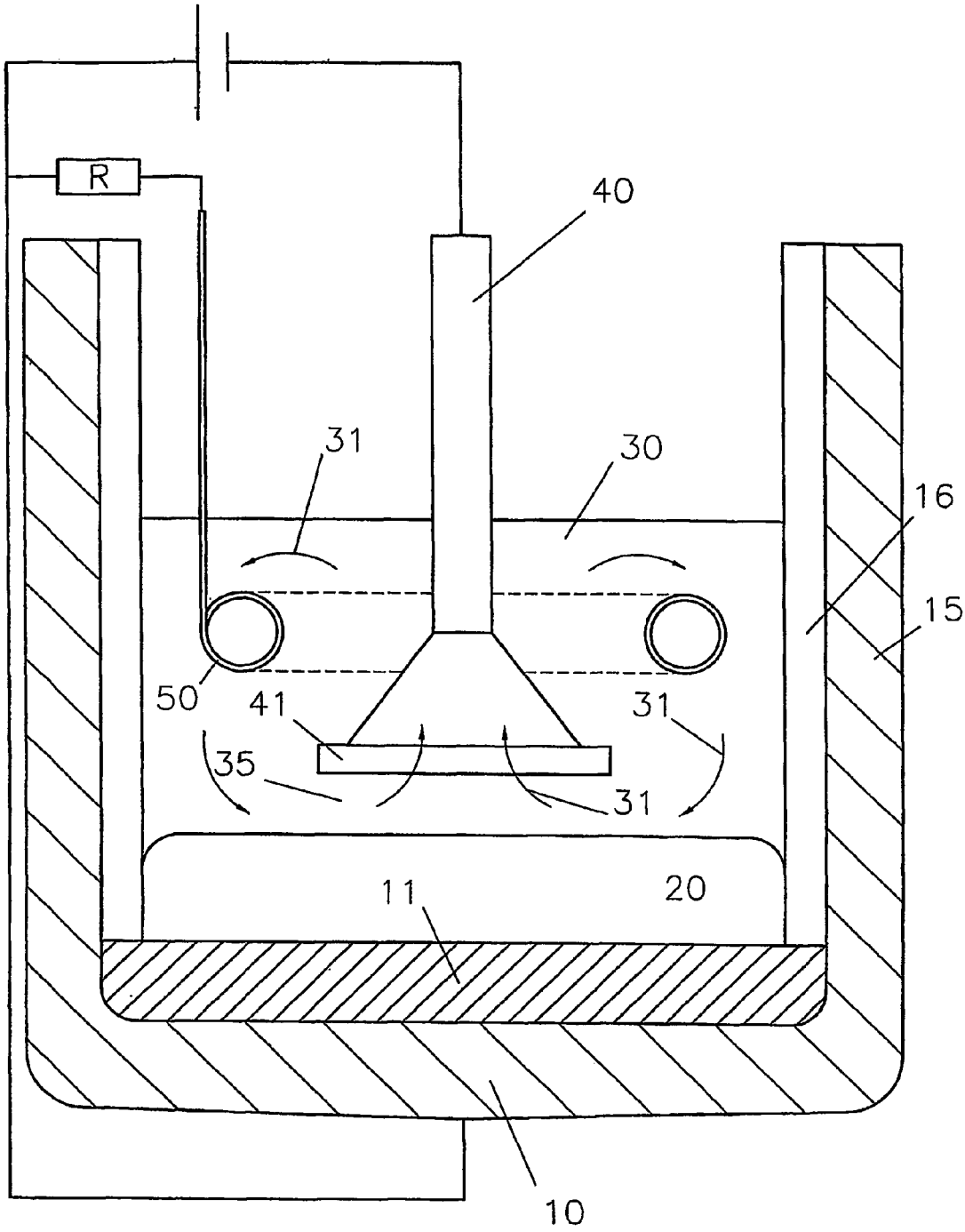
FIG. 1 shows a laboratory scale cell having a collector according to the invention.

FIG. 1 shows a laboratory scale cell having an anode-cathode arrangement as disclosed in greater detail in WO03/083176 (de Nora/Duruz). The cell has a graphite cathodic receptacle 10 whose bottom is rendered aluminium-wettable by a boride-based layer 11. The boride-based layer 11 is covered with a layer of cathodically produced aluminium 20. The sidewalls 15 are covered with a sleeve 16 made of fused alumina. The cathodic receptacle contains a cryolite-based molten electrolyte 30 in which alumina is dissolved.

An oxygen-evolving anode 40 is suspended in the molten electrolyte 30 spaced above the cathodic aluminium 20 by an anode-cathode gap 35. The anode has a grid-like active structure 41, for example as disclosed in WO00/40781, WO00/40782 or WO03/006716 (all de Nora), which is made of a transition metal-containing alloy having an integral oxide layer containing predominantly one or more transition metal oxides which slowly dissolve in the electrolyte and are compensated by oxidation of the alloy at the alloy/oxide layer interface.

The dissolution of anode oxides leads to the presence in electrolyte 30 of species of metals that are liable to contaminate the product aluminium 20 and that have a cathodic reduction potential that is less negative than the cathodic aluminium potential.

According to the invention, an electrically conductive collector 50 for collecting these metal species is placed in the electrolyte 30. Collector 50 is made of a metal wire that has a melting point above the temperature of electrolyte 30, for example an iron wire, formed as a spiral above the periphery of the active anode structure 41. Collector 50 is electrically connected externally through resistor R to cathodic receptacle 10 so that collector 50 is at a potential that is on the one hand less negative than the cathodic aluminium potential to inhibit reduction of aluminium species thereon, and on the other hand at or more negative than the reduction potential of said metal species to allow reduction thereof on the collector 50.

During use, alumina is electrolysed in the anode-cathode gap 35 to produce oxygen on the active anode structure 41 and aluminium on the aluminium layer 20. The escaping oxygen promotes an electrolyte circulation indicated by arrows 31 through the grid-like anode structure 41 towards the surface of electrolyte 30, through the polarised collector 50 and into the anode-cathode gap 35 for electrolysis. Metal species dissolved from the anode 40 are carried by the circulating electrolyte 30 to the polarised collector 50 where they are removed from the circulating electrolyte 30 by reduction on collector 50 before reaching the anode-cathode gap 35 and before exposure of electrolyte 30 to the product aluminium 20.

Figure 2:
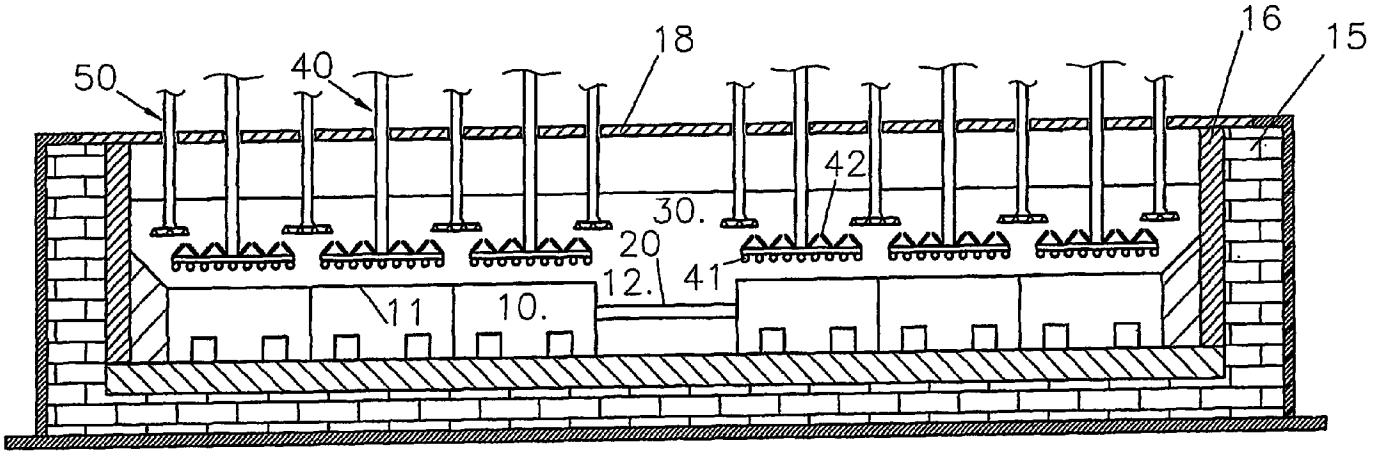
FIG. 2 shows an aluminium electrowinning cell with a series of collectors according to the invention, detailed views of the collectors being shown in FIGS. 2*a* and 2*b;*

The cell shown in FIG. 2 is provided with a series of anodes 40 facing a drained cathode surface formed by an aluminium-wettable coating 11 on cathode blocks 10. Suitable aluminium-wettable coatings are for example disclosed in WO01/42168 (de Nora/Duruz), WO01/42531 (Nguyen/Duruz/de Nora) and WO02/096831 (Nguyen/de Nora). The cell is insulated with an insulating cover 18 and an insulating sidewall 15 covered with a silicon carbide lining 16. This permits ledgeless and crustless operation of molten electrolyte 30 contained in the cell. Insulating cell covers are disclosed in greater detail in WO02/070784 (de Nora/Berclaz) and WO03/102274 (de Nora/Berclaz).

Each anode 40 has a foraminate active anode structure 41 and carries a series of deflectors 42 for promoting an electrolyte circulation though the active anode structure 41. Anode structures of this type are disclosed in greater detail in WO00/40781 (de Nora).

Product aluminium 20 is drained from the aluminium-wettable layer 11 into a central aluminium collection reservoir 12 from where the product aluminium 20 can be tapped. Cell bottoms of this type are disclosed in greater detail in WO00/63463 (de Nora) and WO01/31086 (de Nora/Duruz).

Figure 2B:
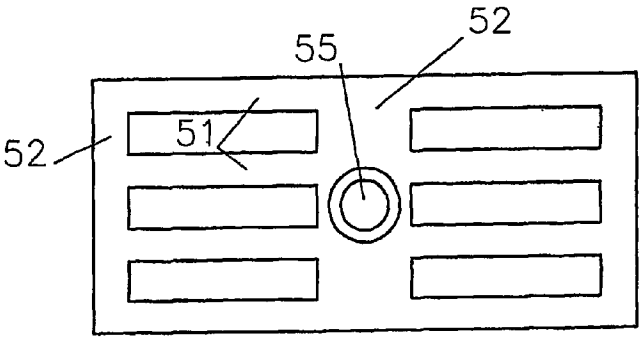
Figure 2A:
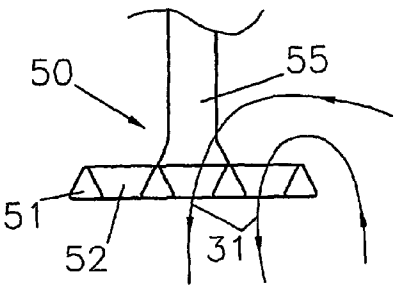

In this embodiment of the invention, the cell comprises a series of collectors 50 which are connected to an external current source and which are arranged for removing from the electrolyte species of elements that are liable to contaminate the product aluminium 20. Collectors 50 are shown in cross-section in FIG. 2*a* and in a plan view in FIG. 2*b*. Furthermore, collectors 50 are suspended by stems 55 above anodes 40. Each collector 50 comprises a horizontally extending foraminate structure in the form of a cast grid comprising longitudinal bars 51 and cross-bars 52. Bars 51,52 have a generally triangular cross-section with rounded edges to guide the electrolyte down-flow and maximise the surface of bars 51,52 that is exposed to the circulating electrolyte 30.

When the anode structures 41 are circular, collectors 50 can be located at a distance thereabove, around the entire periphery of each structure 41 or a significant part thereof. When the anode structures 41 are polygonal (usually square or rectangular) the collectors should be located at least above the anodes' edges where there is a circulation of electrolyte 30 containing contaminating species.

During cell operation, electrolyte 30 is driven by the escape of anodically produced oxygen. The up-flowing electrolyte 30 from the anode structure 41 is intercepted by the polarised bars 51,52 of collectors 50, as shown by arrows 31 in FIG. 2*a*, before recirculation back down to the drained cathode surface 11. This permits removal, by reduction on collectors 50, of species of elements other than aluminium or sodium species from the circulating electrolyte 30 before such species can be reduced on the drained cathode surface 11 and contaminate the product aluminium 20.

Figure 3:
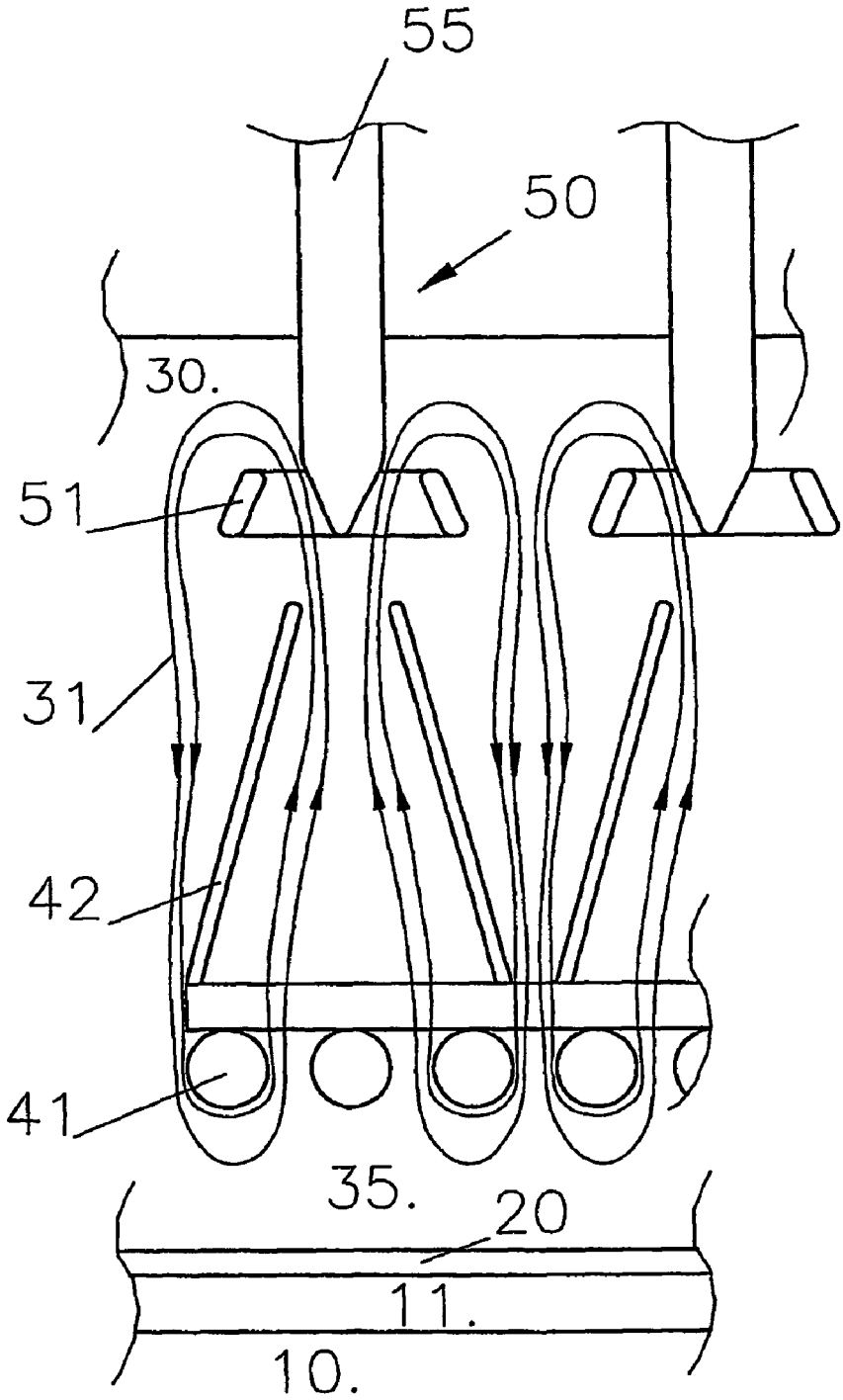
FIG. 3 shows part of an aluminium electrowinning cell with other collectors according to the invention.

FIG. 3, in which the same reference numerals designate the same elements, shows part of an aluminium electrowinning cell having an anode structure 41 with a series of deflectors 42 similar to the ones shown in FIG. 2. Above deflectors 42 are collectors 50 that have a grid comprising bars 51 connected to a stem 55. Bars 51 have inclined surfaces to guide an up-flow of electrolyte 30 that is canalised by the upwardly converging deflectors 42 located underneath collectors 50.

In a variation (not shown), similar deflectors above an anode structure are used on the one hand to promote an electrolyte circulation though the active anode structure and on the other hand as a collector according to the invention. In this case, the deflectors should not be anodically polarised but should be maintained at a lower potential which permits reduction thereon of species of elements that would otherwise contaminate the product aluminium.

Figure 4:
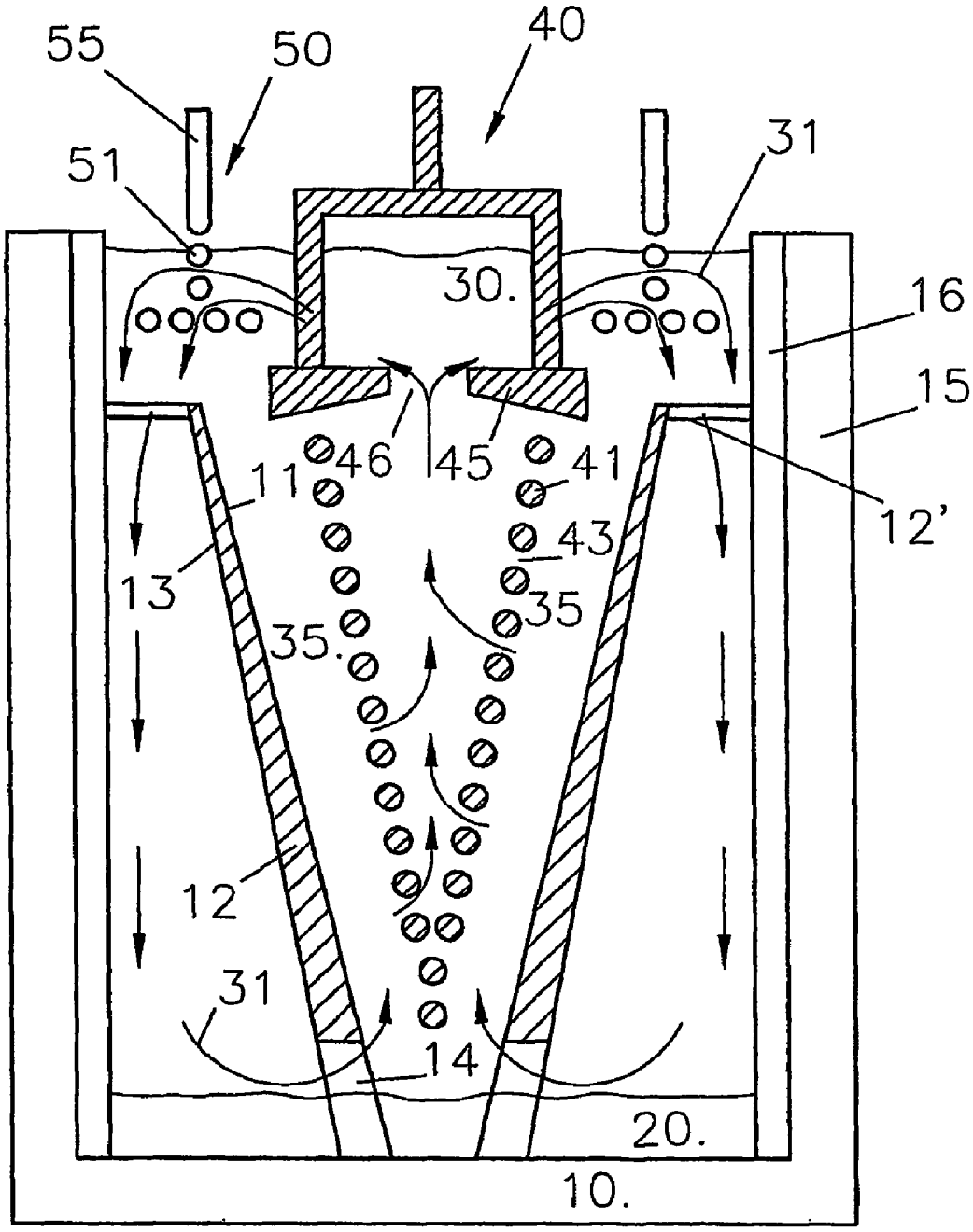
FIG. 4 shows another aluminium electrowinning cell according to the invention.

FIG. 4 shows an aluminium electrowinning cell that has a cathodically polarised horizontal bottom 10 covered with a layer of product aluminium 20.

The cell has two inclined cathodic plates 12 in a molten electrolyte 30. Each plate 12 has an upwardly-orientated sloping aluminium-wettable drained cathode surface 11 separated by an anode-cathode gap 35 from a corresponding sloping active anode surface of an anode 40 having a v-shaped grid-like foraminate active structure 41 covered by an electrolyte guide member 45. The cathodic plates 12 also have a downwardly-orientated inclined rear face 13 in the electrolyte 30. The bottom of the cathodic plates 12 rests on the cell bottom 10 in the aluminium pool 20 through which electrical current is passed from an external current supply to the cathodic plates 12. The cathodic plate 12 has a cut-out 14 in its bottom end for passage of the aluminium pool 20 and for providing a return flow of alumina-enriched electrolyte 30 to the bottom end of the anode-cathode gap 35. Furthermore, the cathodic plate 12 has at its upper edge a pair of horizontally extending flanges 12' that space the active part of plate 12 from the sidewall 15,16 of the cell. A passage 12 is provided adjacent flanges 12' for the down-flow of alumina-enriched electrolyte 30 from above the active anode structure 41 and then behind the drained cathode surface 13 to the lower end of the anode-cathode gap 35.

The anode 40 is suspended in the electrolyte 30 with the downwardly-orientated active anode surface formed by the v-shaped grid-like foraminate structure 41 substantially parallel to the upwardly-oriented cathode surfaces 11. Structure 41 is made of a series of parallel horizontal rods (shown in cross-section) forming a downwardly-oriented generally v-shaped electrochemically active open anode surface. The anode rods are electrically and mechanically connected through one or more cross-members (not shown) and spaced apart from one another by inter-member gaps 43 that form passages for an up-flow of alumina-depleted electrolyte 30.

The cell is arranged to promote a circulation of the molten electrolyte 30, indicated by arrows 31, from and to the anode-cathode gap 35. Specifically, the anode 40 comprises an electrolyte guide member 45 above the v-shaped grid-like anode structure 41 to guide all the up-flowing alumina-depleted electrolyte 30 through a central opening 46 in the guide member 45 to an alumina feeding area thereabove where it is enriched with alumina, and then sideways over and around an upper end of the anode structure 41 so that the alumina-enriched electrolyte 30 is mainly circulated through adjacent flanges 12', along the downwardly-orientated sloping surface 13 of plate 12 and then through the cut-out 14 in the bottom end of plate 12 into a lower end of the anode-cathode gap 35.

Further details and variations of the anode-cathode arrangement of this cell are disclosed in WO03/023092 (de Nora).

In this embodiment of the invention, the cell comprises collectors 50 having a grid structure made of horizontal parallel bars 51 that are connected through cross-members (not shown) in an inverted T arrangement in cross-section. Collectors 50 are suspended by stems 55 above the flanges 12' so that all branches of the inverted T intercept circulating electrolyte 30 indicated by arrows 31.

Collectors 50 are polarised at a potential that is less negative than the cathodic aluminium potential to inhibit reduction thereon of aluminium and that is at or more negative than the reduction potential of species of element(s) that are liable to contaminate the product aluminium 20 to allow reduction of these species on collector 50. Typically, collector 50 is polarised at a potential that is 0.5 to 1.5 V less negative (i.e. more positive) than the cathodic aluminium potential.

During use, alumina dissolved in the electrolyte 30 is electrolysed in the anode-cathode gap 35 to produce aluminium on the cathode surface 11 and oxygen on the anode structure 41. The escaping anodically evolved oxygen promotes an electrolyte circulation carrying dissolved species of anode metals through opening 46 to an area above anode structure 41 where it is enriched with alumina (and possible iron species that may be present as an impurity of the alumina feed), and then through the polarised collector grid 51 which collects by reduction these dissolved species of anode metals and iron, when present, rather than aluminium species. The purified alumina-rich electrolyte 30 is then circulated behind the cathode 12 along surface 13 to cut-out 14 from where it is supplied to a bottom end of the anode-cathode gap 35 for subsequent electrolysis.

Figure 5:
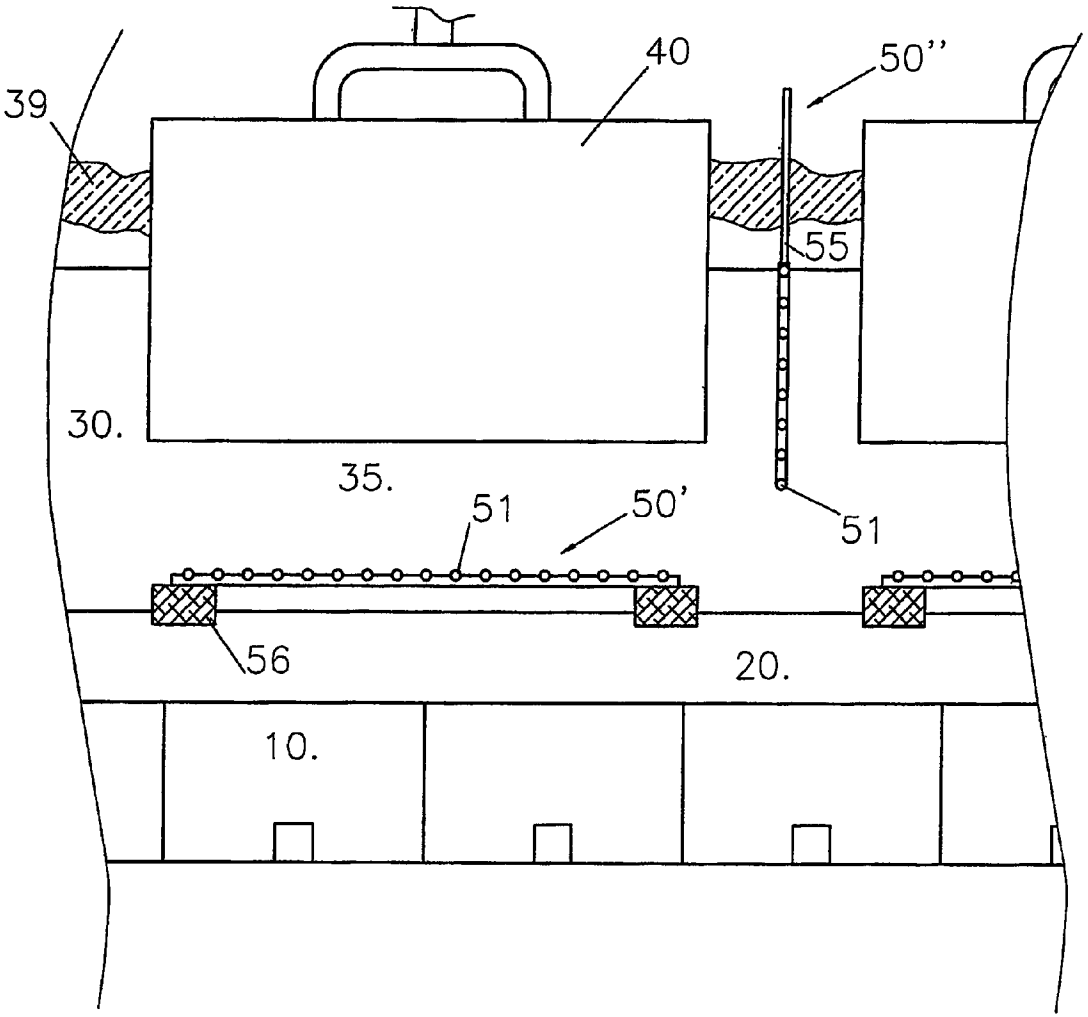
FIG. 5 shows part of an aluminium electrowinning cell fitted with carbon anodes and with collectors of the invention.

FIG. 5 shows part of an aluminium electrowinning cell having conventional consumable carbon anodes 40 suspended in a molten electrolyte 30 and facing a cathodic aluminium pool 20 on a cathode bottom made of conventional carbon blocks 10. The cell has a side ledge (not shown) and a crust 39 made of frozen electrolyte.

The cell comprises collectors 50',50" for removing species of elements that are liable to contaminate the product aluminium 20, which species in this embodiment of the invention are in particular iron species that are present as impurities in the alumina feed as well as sulphur and other minor constituents of carbon anodes 40 and cathode blocks 10.

Two types of collectors are shown in FIG. 5: horizontal collectors 50' in the anode-cathode gap 35 and vertical collectors 50" between adjacent anodes 40. Both collectors 50', 50" have a grid made of conductive bars 51 for the flow-through of electrolyte 30 containing the species of elements liable to contaminate the product aluminium 20, for the removal of such species from the electrolyte by deposition on collectors 50',50".

Each horizontal collector 50' located in the anode-cathode gap 35 comprises floats 56 floating on the aluminium pool 20 for maintaining the grid made of bars 51 well separated from the aluminium pool 20. In this way, the position of the grid follows the variations of the level aluminium pool 20 (and of the consuming anode 40) and is always at substantially the same distance from the cathodic aluminium pool 20 and from the consuming anode 40, and at a substantially constant electrical potential.

An electric charge that is provided to collector 50' by spontaneous oxidation thereon of aluminium and/or sodium metal dissolved in the molten electrolyte can be sufficient to reduce the contaminating metal species and purify the electrolyte 30 for obtaining a high purity product aluminium 20, when the contamination of the electrolyte 30 by said species of contaminating elements is low. In this case, floats 56 are made of electrically non-conductive materials, such as boron nitride. The electrical potential of collector 50' is set by the collector's position in the electrical field between anode 40 and the cathodic aluminium pool 20.

However, an additional electric current should be provided to collector 50' when the contamination of the electrolyte 30 is elevated. This additional current can be provided internally from the cathodic pool 20 by making the floats 56 of a material, e.g. a carbon/boron nitride composite, having an electrical resistivity typically in the range of 0.5 to 10 ohms. In this case, the electrical potential of collector 50 is given by the voltage drop through floats 56.

Each vertical collector 50" is suspended between adjacent anodes 40 (and/or between an anode and a cell sidewall) by a stem 55 that extends through crust 39. Collector 50" is connected electrically to an external current source (not shown) so as to supply to collector 50" a current that is sufficient to remove from the electrolyte 30 species of elements that are liable to contaminate the product aluminium 20.

During operation of the cell of FIG. 5, alumina dissolved in the electrolyte 30 is electrolysed in the anode-cathode gap 35 to produce aluminium that is incorporated in the cathodic pool 20 and evolve $CO_2$ at the carbon anode. Alumina is supplied to the cell through crust 39 between adjacent anodes 40 into the electrolyte 30 where it dissolves. Circulation to the anode-cathode gap 35 of electrolyte 30 enriched with alumina is promoted by the escape of anodically produced $CO_2$ and by motion of the cathodic aluminium pool 20. Electrolyte 30 circulating in the cell flows through the polarised grids of collectors 50',50" whereby species of elements that 5 are liable to contaminate the product aluminium 20 are removed from the circulating electrolyte 30.

Whereas the collectors shown in FIGS. 1, 4 and 5 are all made of an assembled grid of bars, it is evident that each collector could be a cast grid (as shown in FIGS. 2, 2*a*, 2*b* and 3) integral with the stem or to which a stem is attached, or which has no stem at all (as shown in FIG. 5). The assembled or cast bars of the collectors can have any of the profiles of the anode members disclosed in WO00/40782 and WO03/006717 (both de Nora), including profiles that are circular, semi-circular, rectangular . . . Furthermore, a collector can be made of a foraminate structure through which the electrolyte can circulate, e.g. a perforated plate or a reticulated body such as a honeycomb structure or a foam.

The invention will be further described in the following examples.

EXAMPLE 1

A laboratory scale cell as shown in FIG. 1 was operated according to the invention.

The cell had a carbon cathode 10 coated with an aluminium-wettable layer 11 as disclosed in WO02/096831 (Nguyen/de Nora) and an anode 40 made of a surface oxidised cast alloy containing 55 weight % nickel, 32 weight % iron, 10 weight % copper, 2 weight % aluminium and 1 weight % minor additives prepared as described in WO03/078695 (Nguyen/de Nora). The anode 40 was suspended in the cell's fluoride-based molten bath 30 by a stem made of Inconel® (74 weight % nickel, 17 weight % chromium and 9 weight % iron). The molten bath 30 was at a temperature of 925° C. and made of 68.4% cryolite ($Na_3AlF_6$), 11 weight % aluminium fluoride ($AlF_3$), 9.6 weight % alumina ($Al_2O_3$), 7 weight % potassium fluoride (KF), 4 weight % calcium fluoride ($CaF_2$).

Collector 50 was made of a platinum wire (diameter: 1.4 mm) shaped into a spiral (diameter: 15 mm) that extended horizontally 2 cm above the anode 40. The collector was electrically connected to the cathode 10 through an external resistance R of 0.33 ohm.

The cell was tested by passing an electrolysis current from the cathode 10 to the anode 40 at an anodic current density of 0.8 A/cm$^2$. Collector 50 was polarised at an electric potential that was about 0.5 to 0.6 V above the potential of the cathode 10, i.e. not low enough to permit aluminium deposition thereon, and about 3.0 to 3.1 V below the potential of the anode 40, i.e. sufficiently low to avoid dissolution of platinum from the collector. An electric current of 12 to 15 mA was passed from the cathode 10 to the collector 50 through the external resistance R, which led to a current density of about 9 mA/cm$^2$ at the surface of the collector 50. The current passing through the collector corresponded to about 0.2% of the total current passing to the anode.

During electrolysis alumina was electrolysed in bath 30 and aluminium 20 produced on cathode layer 11. Species of metals from anode 40 (iron, nickel, copper . . . ) slowly dissolved in electrolyte 30 that circulated around the collector 50 and were reduced thereon.

After 44 hours electrolysis was interrupted and collector 50 extracted from electrolyte 30. The platinum collector was covered with a ceramic layer of mainly nickel and iron oxides and small amounts of oxides of copper and other metals, including chromium that had dissolved from the anode's stem.

The product aluminium 20 was analysed and showed a contamination of about 200 ppm iron, 150 ppm nickel and 50 ppm of other metals.

EXAMPLE 2

The cell test of Example 1 was repeated several times with different collector wires, including a copper wire, a nickel wire, an iron wire and a wire made of an alloy having the composition of the anode's alloy. The results of these tests were virtually the same as in Example 1. This showed that using a non-noble metal worked as well as a noble metal like platinum.

EXAMPLE 3 (COMPARATIVE)

The cell test of Example 1 was repeated but without using the collector of the invention. The cell was operated under the same conditions as in Example 1 except that the collector was absent.

After 44 hours the test was interrupted and the product aluminium analysed. A contamination of about 2300 ppm iron, 1500 ppm nickel and 600 ppm of other metals was found in the product aluminium.

As can be seen from these measured values, the contamination of the product aluminium by anode constituents such as nickel and iron is about ten times lower when the collector of the invention is used.

While the invention has been described in conjunction with specific embodiments thereof, it is evident that many alternatives, modifications, and variations will be apparent to those skilled in the art in the light of the foregoing description. Accordingly, it is intended to embrace all such alternatives, modifications and variations which fall within the scope of the appended claims.

In particular, in the case where the collector collects metals having the same composition as the working metal-based anode, once the working anode is worn and the collector is covered with a plating of metal from the anode, the collector and the anode can be inverted so that the collector is anodically polarised to operate as an anode whereas the worn anode is polarised to operate as a collector.

The invention claimed is:

1. A cell for electrowinning a metal from a compound thereof dissolved in a molten salt electrolyte, the cell containing said molten salt electrolyte in which a compound of said metal is dissolved, in particular for electrowinning aluminium from alumina dissolved in the molten electrolyte, said cell comprising an anode and a cathode that contact the molten electrolyte, the cathode being during use at a cathodic potential for reducing thereon species of the metal to be produced from the dissolved compound, the electrolyte further containing species of at least one element that is liable to contaminate the product metal and that has a cathodic reduction potential which is less negative than the cathodic potential of the metal to be produced, wherein the cell further comprises a collector for removing species of said element(s) from the electrolyte, said collector having an electrically conductive surface in contact with the molten electrolyte, the conductive collector surface being during use at a potential that is:

less negative than the cathodic potential of the produced metal to inhibit reduction thereon of species of the metal to be produced; and at or more negative than the reduction potential of the species of said element(s) to allow reduction thereof on the conductive collector surface, the cell being so arranged that species of said element(s) are reduced on the conductive collector surface rather than on the cathode so as to inhibit contamination of the product metal by said element(s).

2. The cell of claim 1, wherein the cell is arranged to promote during use an electrolyte circulation from and towards the cathode, the conductive collector surface being exposed to molten electrolyte that circulates towards the cathode and that contains the species of said element(s).

3. The cell of claim 2, wherein the conductive collector surface is positioned outside a gap spacing the anode and the cathode, the conductive surface being electrically connected to a means for applying a potential.

4. The cell of claim 1, wherein the conductive collector surface is positioned between the anode and the cathode.

5. The cell of claim 4, wherein the conductive collector surface is electrically connected to a voltage source.

6. The cell of claim 4, wherein the potential of the conductive collector surface is set by its position relative to the anode and cathode.

7. The cell of claim 1, comprising a means for supplying to the conductive collector surface a current for reducing species of said element(s) on the conductive collector surface during use.

8. The cell of claim 1, wherein the electrolyte contains dissolved product metal and/or another metal that during use is/are oxidised on the conductive collector surface to pass an electric charge that reduces species of said element(s) on the conductive surface.

9. The cell of claim 8 for electrowinning aluminium, wherein the electrolyte is a sodium-containing electrolyte and said other metal is sodium that is reduced from the electrolyte.

10. The cell of claim 1, wherein the conductive surface of the collector is made of carbon.

11. The cell of claim 1, wherein the conductive surface of the collector is metal-based, the conductive surface being at a potential below the potential of electrochemical dissolution of the metal-based surface.

12. The cell of claim 11, wherein said metal-based surface comprises at least one metal selected from titanium, vanadium, chromium, manganese, iron, cobalt, nickel, copper, yttrium, zirconium, niobium, molybdenum, ruthenium, rhodium, palladium, hafnium, tungsten, rhenium, iridium, platinum and gold, and/or a compound thereof such as an oxide or a boride.

13. The cell of claim 1, wherein the species of said element(s) comprise species of at least one metal selected from nickel, iron, copper, cobalt, titanium, chromium, manganese, yttrium, cadmium, tin, antimony, gold, platinum, silver, cerium, palladium, ruthenium, tungsten, bismuth and lead.

14. The cell of claim 13, wherein the anode has a surface that comprises one or more of said metal(s) in metallic form and/or in a compound.

15. The cell of claim 1, which comprises one or more carbon anodes.

16. The cell of claim 1, wherein the species of said element(s) comprise species of at least one metalloid or non metal such as sulphur.

17. The cell of claim 1, wherein the conductive collector surface is formed by one or more elongated members.

18. The cell of claim 17, wherein the conductive collector surface is formed by a wire, in particular a spiral.

19. The cell of claim 17, wherein the conductive collector surface is formed by one or more bars, in particular a grid.

20. The cell of claim 1, wherein the collector surface is formed by a foraminate structure through which the electrolyte can circulate, in particular a structure in the form of a perforated plate, a honeycomb structure or a foam.

21. A method of electrowinning a metal in a cell as defined in claim 1, comprising:

a) setting the cathode at a cathodic potential for reducing thereon species of the metal to be produced;

b) setting the conductive surface of the collector at a cathodic potential that is:

less negative than the cathodic potential of the metal to be produced to inhibit reduction thereon of species of the metal to be produced; and at or more negative than the reduction potential of the species of said element(s);

c) producing the metal on the cathode from the dissolved compound of the metal to be produced; and d) reducing species of said element(s) on the conductive collector surface rather than on the cathode so as to inhibit contamination of the product metal by said element(s).

22. The method of claim 21, wherein the conductive collector surface is at a potential in the range from 0.5 to 1.5 V above the cathodic potential of the metal to be produced, in particular from 0.7 to 1.2 V thereabove.

23. The method of claim 22 for electrowinning a metal selected from aluminium, magnesium, titanium, manganese, sodium, potassium, lithium, zirconium, tantalum and niobium.

* * * * *